US006283099B1

(12) United States Patent
Dopona

(10) Patent No.: US 6,283,099 B1
(45) Date of Patent: Sep. 4, 2001

(54) INTERNAL COMBUSTION ENGINE

(75) Inventor: Michael Dopona, Kremsmünster (AT)

(73) Assignee: Bombardier-Rotax Gesellschaft mbH, Gunskirchen (AT)

( * ) Notice: Subject to any disclaimer, the term of this patent is extended or adjusted under 35 U.S.C. 154(b) by 0 days.

(21) Appl. No.: 09/486,795

(22) PCT Filed: Jul. 6, 1999

(86) PCT No.: PCT/AT99/00169

§ 371 Date: Mar. 2, 2000

§ 102(e) Date: Mar. 2, 2000

(87) PCT Pub. No.: WO00/03138

PCT Pub. Date: Jan. 20, 2000

(30) Foreign Application Priority Data

Jul. 8, 1998 (AT) ..... 1176/98

(51) Int. Cl.[7] ..... F02M 23/00
(52) U.S. Cl. ..... 123/533
(58) Field of Search ..... 123/192.2, DIG. 5, 123/531, 533

(56) References Cited

U.S. PATENT DOCUMENTS

| | | | | |
|---|---|---|---|---|
| 923,054 | * | 5/1909 | Lietzenmayer | 123/533 |
| 2,111,899 | * | 5/1938 | Ralston | 123/533 |
| 2,215,911 | * | 9/1940 | Peterson | 123/533 |
| 4,470,380 | | 9/1984 | Walker . | |
| 4,509,474 | | 4/1985 | Schmuck . | |
| 4,616,608 | | 10/1986 | Shiga . | |
| 4,674,462 | | 6/1987 | Koch et al. . | |
| 5,233,952 | * | 8/1993 | Isaka | 123/533 |
| 5,255,643 | * | 10/1993 | Mochizuki et al. | 123/533 |
| 5,438,968 | * | 8/1995 | Johnson et al. | 123/509 |
| 5,715,784 | * | 2/1998 | Okui et al. | 123/192.2 |
| 6,055,962 | * | 5/2000 | Kirk | 123/533 |

FOREIGN PATENT DOCUMENTS

| | | | | |
|---|---|---|---|---|
| 87433 | * | 2/1922 | (AT) | 123/533 |
| 887 430 | | 11/1952 | (DE) . | |
| 41 24 072 | | 2/1992 | (DE) . | |
| 566054 | * | 2/1924 | (FR) | 123/533 |
| 756 876 | | 12/1933 | (FR) . | |
| 2 573 480 | | 5/1986 | (FR) . | |
| 11 030 | | 6/1913 | (GB) . | |
| 2 117 837 | | 11/1982 | (GB) . | |

* cited by examiner

*Primary Examiner*—Erick Solis
(74) *Attorney, Agent, or Firm*—Pillsbury Winthrop LLP

(57) ABSTRACT

An internal combustion engine has a crankcase (2) and a fuel injection system (21) supplied with compressed air, whose piston compressor (12) has a piston (15) guided in a cylinder (18) and a driving crankshaft in operating connection with the engine crankshaft (6). To produce favorable construction conditions, the crankcase (2) constitutes the cylinder (18) for the piston (15) of the piston compressor (12).

3 Claims, 2 Drawing Sheets

II
12
20
1

17
19
16
15
18
3
14
11
13
10
6
5
4
2
9
II
7

INTERNAL COMBUSTION ENGINE

TECHNICAL FIELD

The invention relates to an internal combustion engine with a crankcase and a fuel injection system supplied with compressed air, whose piston compressor has a piston guided in a cylinder and a driving crankshaft in operating connection with the engine crankshaft.

STATE OF THE ART

It is known in two-stroke internal combustion engines (U.S. Pat. No. 4,674,462) to provide a fuel injection supplied with compressed air, which is connected to a piston compressor whose driving crankshaft is in operating connection with the engine crankshaft by a belt drive. Although a fuel injection assisted by compressed air has advantages not only in two-stroke but also in four-stroke internal combustion engines, these advantages may be achieved only with relatively high construction costs, which is due primarily to the piston compressor whose space requirement must be taken into consideration.

SUMMARY OF THE INVENTION

The object of the invention is, therefore, to design an internal combustion engine with a fuel injection system supplied by compressed air so that the space and construction requirements resulting from the piston compressor are substantially reduced.

In an internal combustion engine of the first described type, the invention reaches this object by making the crankcase the cylinder for the piston of the piston compressor.

This produces the advantageous condition of being able to do away with a housing for the piston compressor because the crankcase of the internal combustion engine serves as the housing for the piston compressor if the crankcase constitutes its cylinder. For example, a cylindrical bushing for the piston of the piston compressor may be inserted in a cylindrical bore of the crankcase for this purpose. However, it would also be possible to guide the piston of the piston compressor directly in a coated cylindrical bore of the crankcase. Regardless of the selected mode of construction, a cylinder constituted by the crankcase dispenses with the cost for the housing unavoidable in the known constructions, in addition to which the arrangement saves space because the cylinder with the piston of the piston compressor may be arranged in the upper part of the crankcase without any change in the cylinder block of the internal combustion engine.

Although a direct drive by the crankshaft would be possible, particularly advantageous construction conditions are obtained if a compensating shaft driven by, and parallel to, a crankshaft mounted in the crankcase constitutes the driving crankshaft for the piston compressor because, in this case, the crankshaft remains free and the compensating shaft, which is present anyhow, may be used for this purpose so that there is no expense that would otherwise be connected with the arrangement of the crank drive for the piston compressor. However, the compensating shaft must be so designed with respect to the compensating masses that the mass forces and moments of the crank drives of the internal combustion engines as well as the piston compressor are taken into consideration.

If the compensating shaft projecting beyond its bearing on the side of the piston compressor carries a crank arm at its end face to which the piston rod of the piston compressor is floatingly linked, the conventional mounting of the compensating shaft in the crankcase may be retained, which must be preferred for receiving the piston compressor at the end face over the compensating shaft. Such a crankcase structure may be readily taken into consideration when the crankcase is cast so that any additional cost connected therewith hardly counts.

BRIEF DESCRIPTION OF THE DRAWING

The drawing illustrates the subject matter of the invention by way of example. There are shown in FIG. 1 a two-stroke internal combustion engine in a schematic, partly exposed end view of the crankcase, in the area of the piston compressor, and FIG. 2 a section alone line II—II of FIG. 1.

PREFERRED EMBODIMENT OF THE INVENTION

Figure 1:
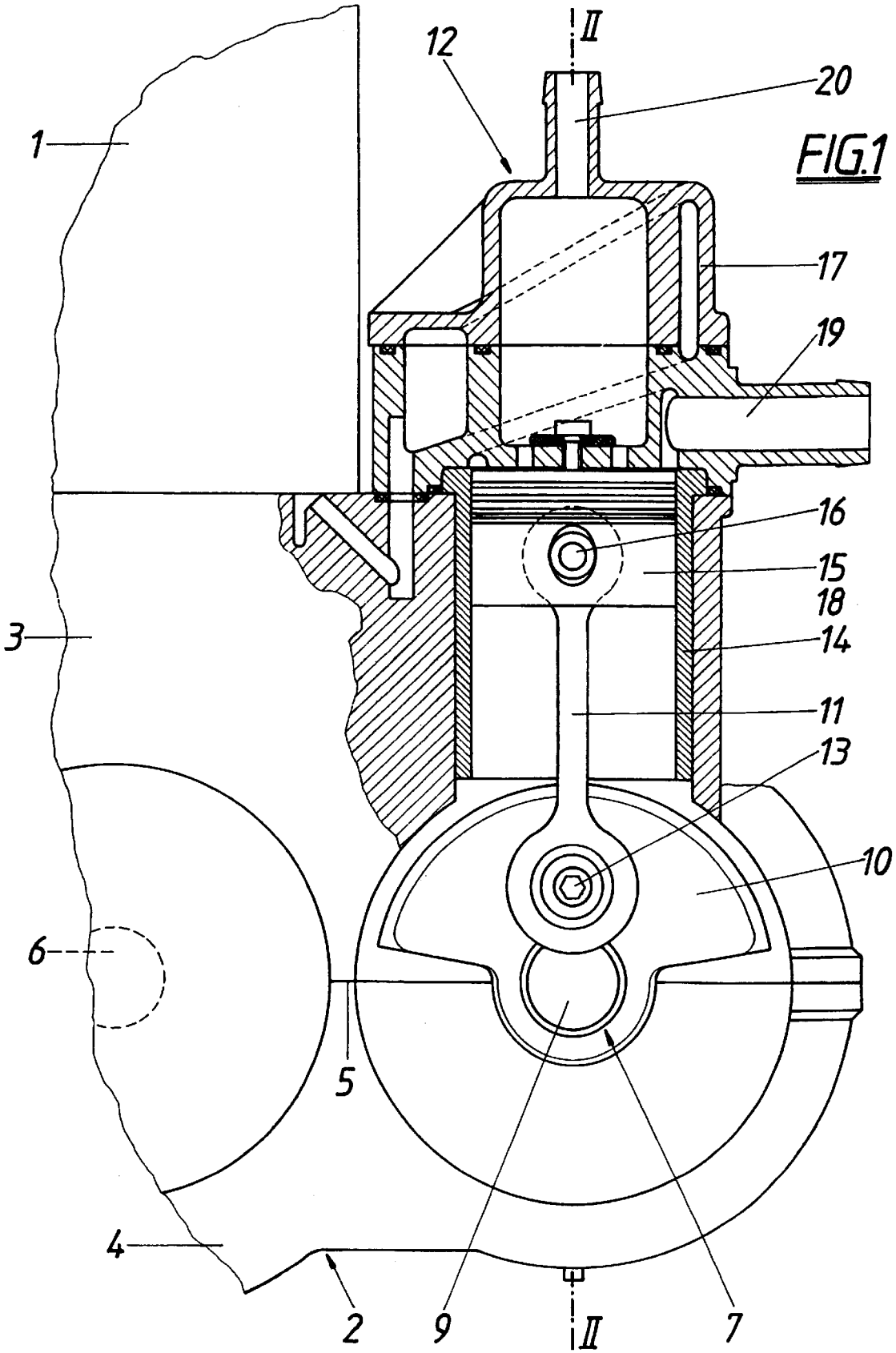

As may be seen in FIG. 1, the two-stroke internal combustion engine according to the illustrated embodiment has a cylinder block 1 to which is attached a crankcase 2 comprising upper part 3 and lower part 4. Not only engine crankshaft 6 but also a compensating shaft 7 are mounted in separating plane 5 between upper part 3 and lower part 4 of crankcase 2, the compensating shaft rotating at the same speed as, but in the opposite direction to, crankshaft 6. By suitably matching the compensating weights of crankshaft 6 and compensating shaft 7, a substantial compensation of the resultant mass forces and moments of the first order may be achieved.

Figure 2:
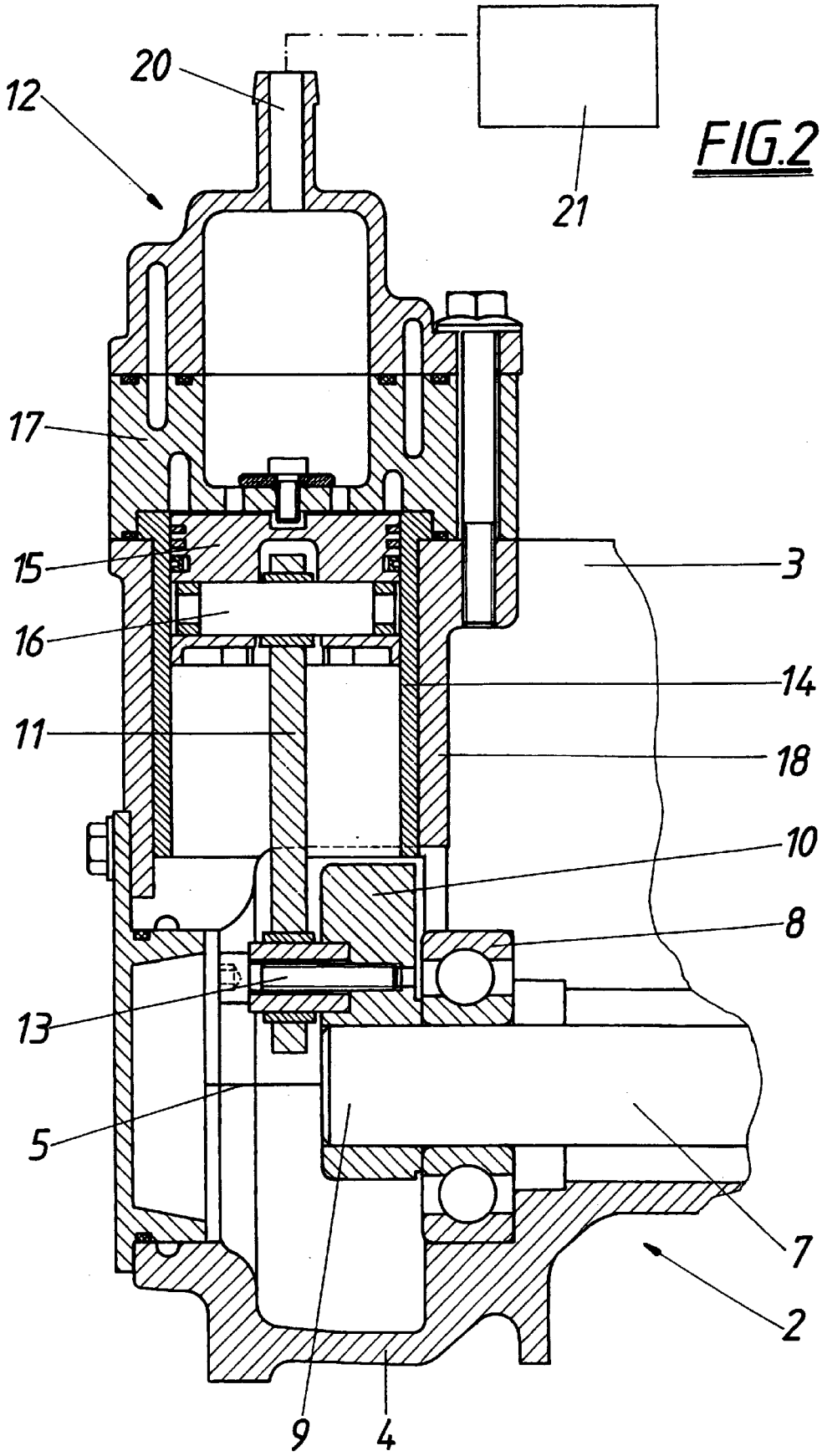

As shown in FIG. 2, compensating shaft 7 projects axially beyond end bearing 8 and its projecting end 9 carries crank arm 10 to which rod 11 of piston compressor 12 is floatingly linked. The linking axles is designated 13. Piston compressor 12 has a cylindrical bushing 14 for a piston 15. The cylindrical bushing is inserted in upper part 3 of crankcase 2 and the piston is connected to rod 11 by bolt 16. Cylinder head 17 of piston compressor 2 is flanged to cylinder 18 formed by upper part 3 of crankcase 2. During the operation of the two-stroke internal combustion engine, compensating shaft 7 is driven by engine crankshaft 6 and constitutes a driving crankshaft for piston compressor 12 whose piston 15 sucks in air from intake conduit 19 in the downstroke and supplies it in a conventional manner to pressure conduit 20 during the compression stroke. This compressed air is supplied to a fuel injection system 21 (FIG. 2), which has not been illustrated in detail for the sake of clarity, to inject a metered and pre-mixed amount of fuel into the cylinder of the two-stroke internal combustion engine.

Since compensating shaft 7 mounted in crankcase 2 constitutes the driving crankshaft for piston compressor 12 and piston 15 of the piston compressor 12 is guided in upper part 3 of crankcase 2 forming cylinder 18, crankcase 2 also functions as the housing of piston compressor 12. This produces particularly favorable construction conditions because it dispenses with a separate housing for a driving crankshaft for piston compressor 12. In addition, there is no need for a separate driving connection between piston compressor 12 and engine crankshaft 6 because compensating shaft 7 drives piston compressor 12. Furthermore, this arrangement saves space so that the construction and the drive for piston compressor 12 provide simple assembly conditions. In this connection, it must also be noted that a suitable arrangement and matching of the compensating masses make possible a substantial compensation of the mass forces and moments of the first order of the crank drive of the internal combustion engine as well as piston compressor 12.

Although the invention has been described in detail in connection with the illustrated two-stroke internal combustion engine, it is by no means limited to this field of utilization and it may obviously be used in four-stroke internal combustion engines with a fuel injection system supplied with compressed air, too. In that case, the described advantages are also obtained, and additional drive possibilities for the piston compressor may be available because the drive for the piston compressor may be provided not only by the crankshaft or the compensating shaft but additionally, for example, by a water pump shaft or by the camshaft itself.

What is claimed is:

1. An internal combustion engine, comprising:

a crankcase;

a crankshaft;

a fuel injection system supplied with compressed air comprising a piston compressor with a piston guided in a cylinder, the piston being operatively connected to the engine crankshaft, the cylinder for the piston of the piston compressor being integrally formed within the crankcase.

2. The internal combustion engine according to claim 1, further comprising:

a compensating shaft driven by, and parallel to, the crankshaft, wherein the compensating shaft is mounted in the crankcase and drives the piston compressor.

3. The internal combustion engine according to claim 2, further comprising:

a bearing in the crankcase, disposed adjacent the piston compressor, wherein an end of the compensating shaft extends through and projects beyond the bearing;

a crank arm connected at the end of the compensating shaft; and a piston rod connected between the crank arm and the piston.

* * * * *